US005294318A

United States Patent [19]

Grant, Jr. et al.

[11] Patent Number: 5,294,318

[45] Date of Patent: Mar. 15, 1994

[54] CRUSTBREAKING ASSEMBLY FOR ALUMINUM ELECTROLYSIS CELLS

[75] Inventors: Louis A. Grant, Jr., Pittsburgh; Albert J. Kristoff, Allison Park, both of Pa.

[73] Assignee: Louis A. Grant, Inc., Pittsburgh, Pa.

[21] Appl. No.: 914,863

[22] Filed: Jul. 15, 1992

[51] Int. Cl.[5] ..... C25C 3/14

[52] U.S. Cl. ..... 204/245; 204/279; 173/147

[58] Field of Search ..... 204/245, 279; 173/147, 173/151; 83/614

[56] References Cited

U.S. PATENT DOCUMENTS

| | | | |
|---|---|---|---|
| 2,832,567 | 4/1958 | Fletcher et al. | 173/147 X |
| 3,346,300 | 10/1967 | Grant | 299/70 |
| 3,389,755 | 6/1968 | Grant | 173/44 |
| 3,458,396 | 7/1969 | Grant | 173/35 |
| 3,664,946 | 5/1972 | Schaper et al. | 204/243 R |
| 4,049,529 | 9/1977 | Golla | 204/245 X |
| 4,328,085 | 5/1982 | Friedli et al. | 204/245 |
| 4,437,964 | 3/1984 | Gerphagnon et al. | 204/245 |
| 4,702,324 | 10/1987 | Peinecke et al. | 204/245 X |
| 5,020,183 | 6/1991 | Grant, Jr. | 15/246.5 |
| 5,108,557 | 4/1992 | Nordquist | 204/245 X |

*Primary Examiner*—Donald R. Valentine

*Attorney, Agent, or Firm*—Webb, Burden, Ziesenheim & Webb

[57] ABSTRACT

A crustbreaking assembly comprising elongated rails supported on a frame and a carriage moveable along the length of the rails. A slide assembly pivotally mounted on the carriage for rotation about an axis which is substantially parallel to the rails. A hammer assembly mounted on the slide assembly with a longitudinal axis substantially perpendicular to the rails and including a reciprocable cutting bit which reciprocates along the longitudinal axis of the hammer assembly.

20 Claims, 5 Drawing Sheets

CRUSTBREAKING ASSEMBLY FOR ALUMINUM ELECTROLYSIS CELLS

This invention relates generally to a crustbreaking assembly and, more particularly, to a crustbreaking assembly for breaking the crust formed on the fused electrolyte in an aluminum fusion electrolysis cell.

BACKGROUND OF THE INVENTION

1. Field of the Invention

Crustbreaking in electrolysis cells can be performed manually with jackhammers and other manually operated impact devices. However, manual operations are hazardous to the workers and are both slow and expensive. Pneumatically operated crustbreaking equipment has been used but such mechanical crustbreakers are not capable of removing crust formed along the edges and in the corners of electrolysis cells.

2. Description of the Prior Art

Known crustbreakers have been designed to remove slag along cell edges and corners by using an articulated impact tool. For example, U.S. Pat. No. 3,664,946 discloses a crustbreaker supported on a semiportable trolley carriage which has a swingable beam with a pneumatic impact tool hinged to the free end of the beam. Although this crustbreaker permits contacting crust located at the extremities of an electrolysis cell, it is complicated and relatively slow and cumbersome to operate. Also, it is not suited for working in a corrosive environment, and due to the pivot arrangement of the impact tool, it does not always cleanly break the crust.

SUMMARY OF THE INVENTION

One object of the invention is to avoid the aforementioned drawbacks of prior art crustbreaker arrangements.

A second object of the invention is a self-contained mechanical crustbreaker assembly.

Another object of the invention is to provide a crustbreaker assembly which is adapted to break crust located around the entire periphery of an electrolysis cell.

It is also an object of the invention to improve the speed and efficiency of crustbreaking in electrolysis cells.

It is a further object of the invention to develop a crustbreaker assembly that is electrically insulated from the pot cell superstructure to eliminate a short circuit between anodes and cathodes.

In accordance with the invention, a crustbreaker assembly for use in electrolysis cells comprises a reciprocating hammer assembly which rides along a slide assembly. A motor on the hammer assembly rotates a hammer cutting tip about its longitudinal axis. Apparatus is included to rotate the attached hammer assembly about an axis which is substantially perpendicular to the longitudinal axis of a carriage assembly which holds the slide and hammer assemblies. The carriage assembly is slidable along rails extending substantially perpendicular to the longitudinal axis of the hammer assembly and substantially parallel to the rotational axis of the hammer assembly. The hammer is constructed to receive a variety of cutting bits.

These as well as other features and advantages of the invention will become more apparent when reference is made to the detailed specification taken with the accompanying drawings. Although a preferred embodiment of the invention is disclosed in the drawings, it is to be understood that the drawings are for the purpose of illustration only without limiting the invention.

DESCRIPTION OF THE PREFERRED EMBODIMENT

Figure 1:
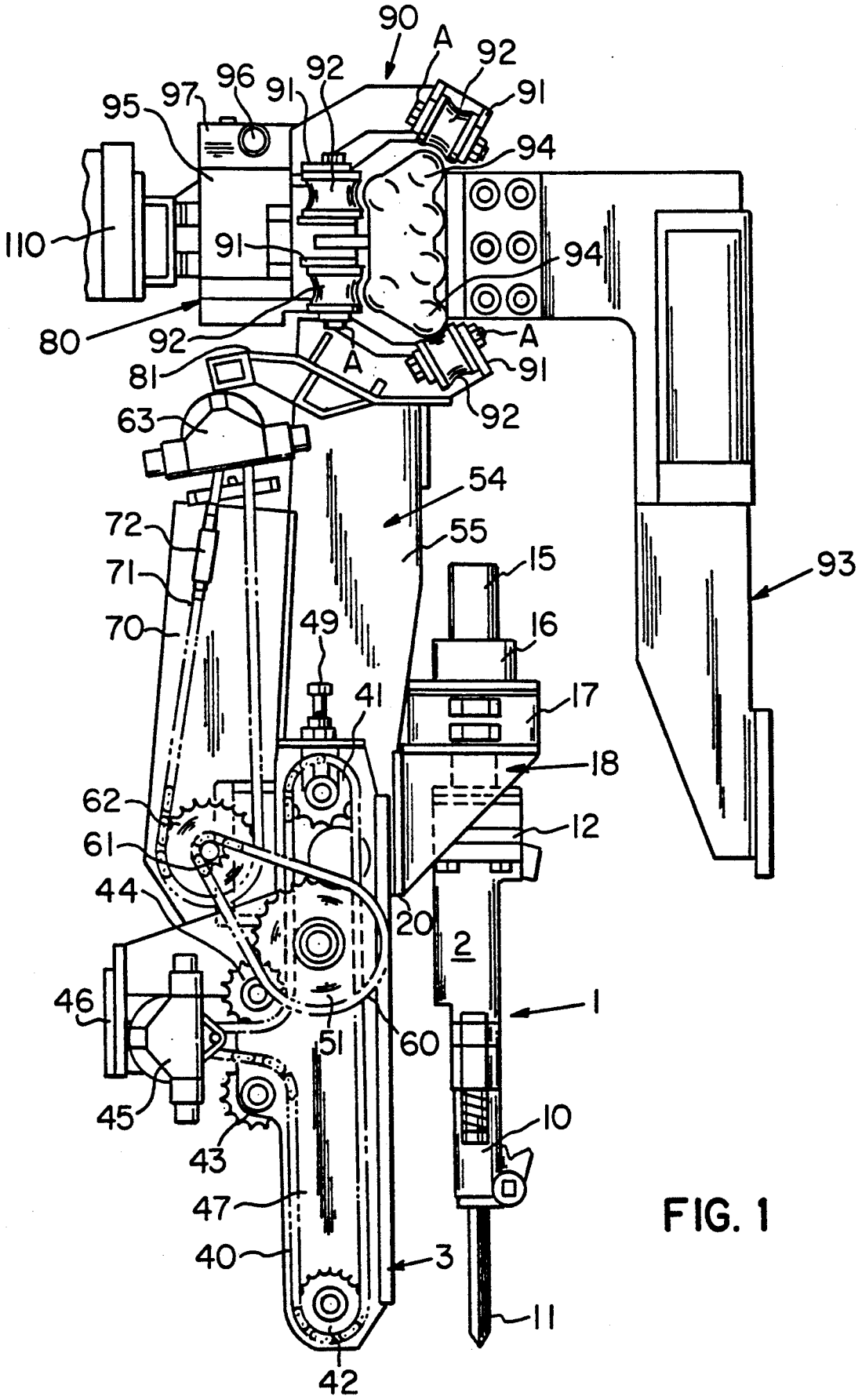
FIG. 1 is a side view of the crustbreaker assembly according to the invention.

As shown in FIG. 1 of the drawings, crustbreaking assembly 1 includes a hammer assembly 2 which is adapted to reciprocate along a slide assembly 3. Slide assembly 3 and hammer assembly 2 are supported on a moveable carriage which rides along a plurality of rails to position the carriage relative to an electrolysis cell.

Figure 2:
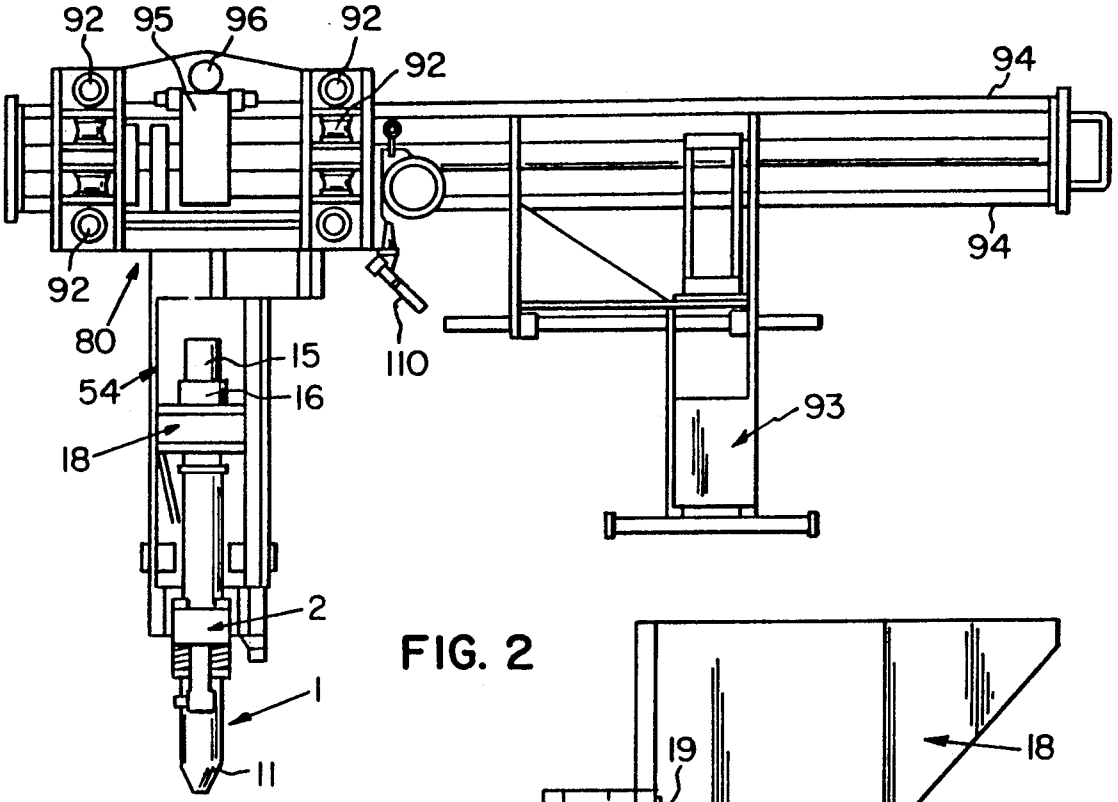
FIG. 2 is a front view of the crustbreaker assembly shown in FIG. 1.
Figure 3:
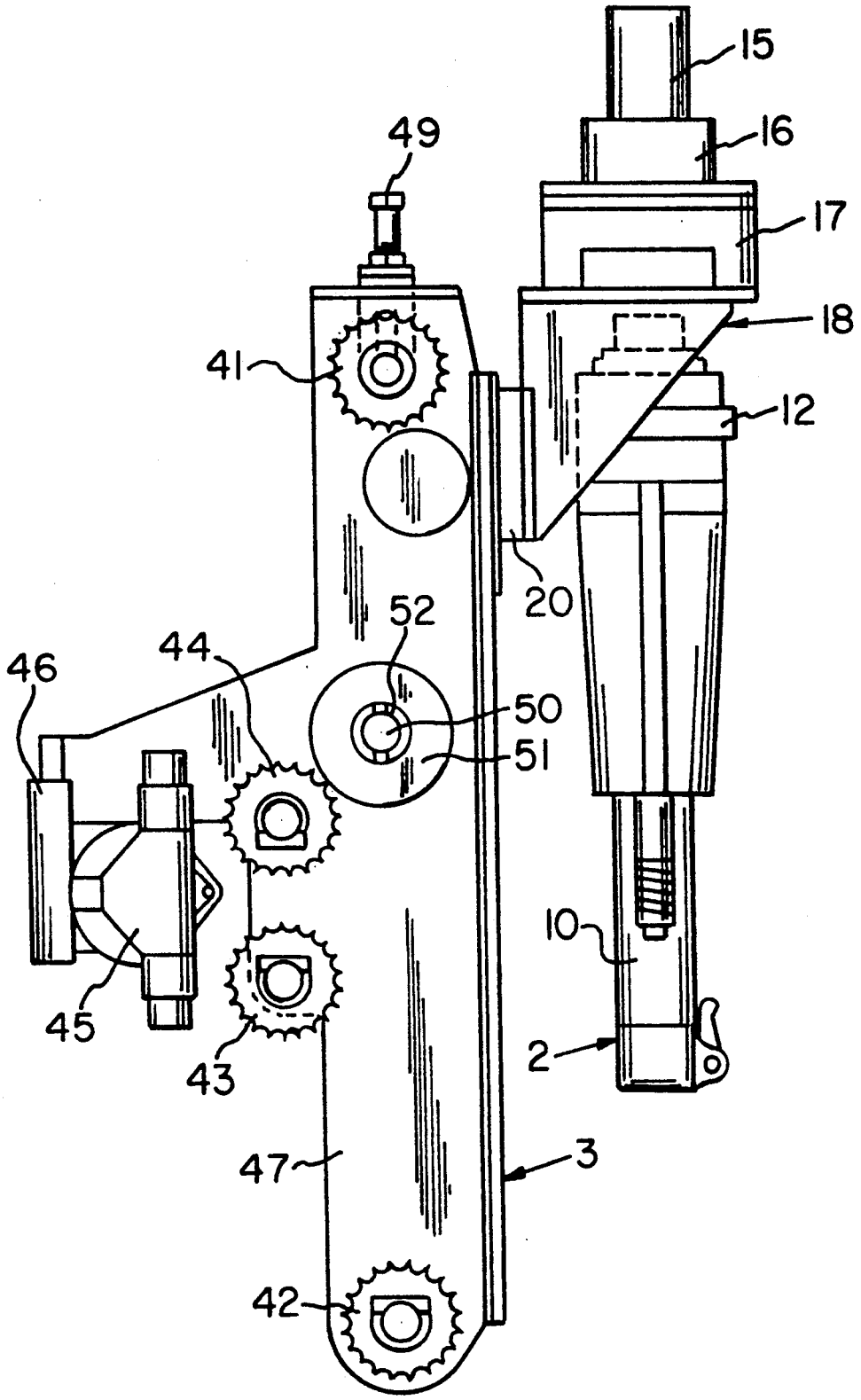
FIG. 3 is a side view of the hammer assembly and the slide assembly shown in FIGS. 1 and 2.
Figure 6:
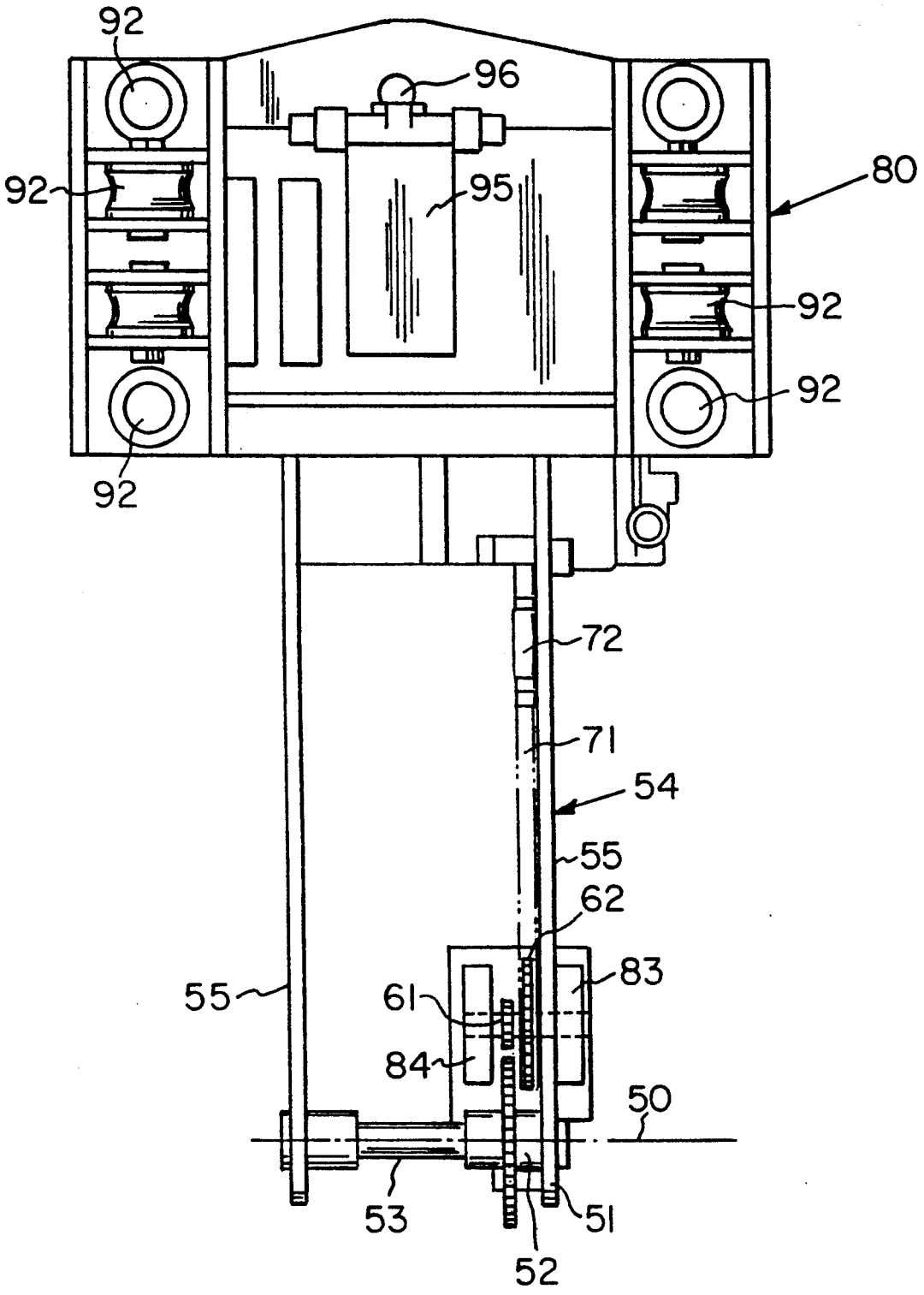
FIG. 6 is a front view of the carriage frame shown in FIG. 2 with the hammer assembly removed.
Figure 7:
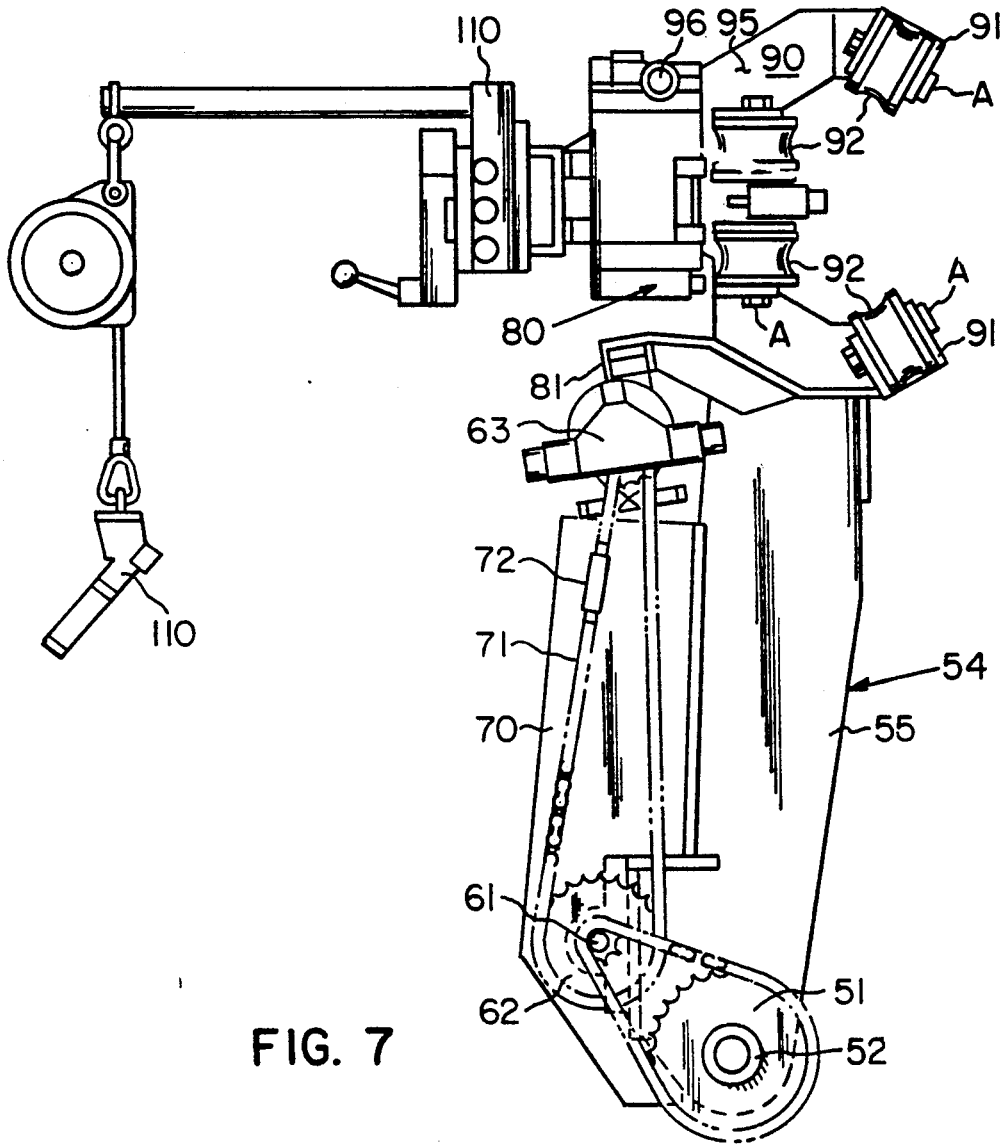
FIG. 7 is a side view of the carriage frame shown in FIG. 6 including the controls.
Figure 8:
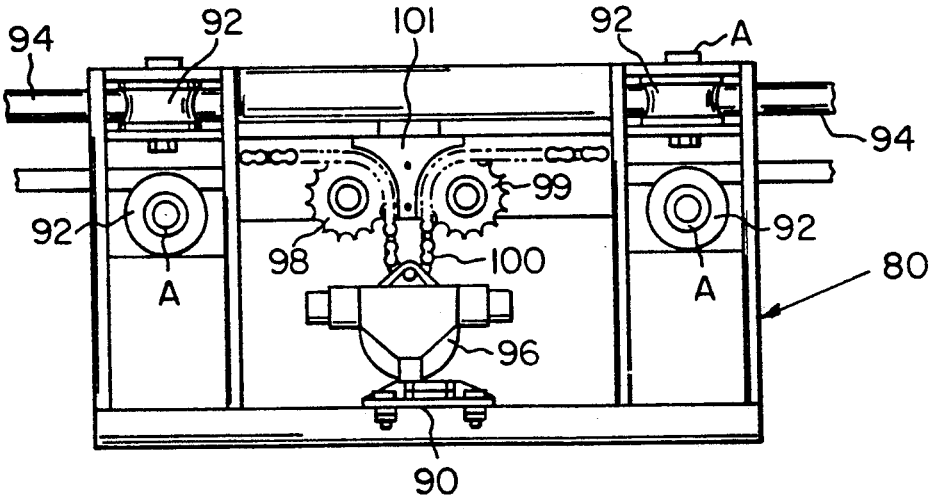
FIG. 8 is a top view of the carriage frame shown in FIGS. 6 and 7 including the carriage drive unit.

As shown in FIGS. 2 and 3 of the drawings, hammer assembly 2 includes a conventional hammer 10 which can receive a variety of conventional cutting bits 11. For example, the cutting bit shown in FIG. 1 is a mold point bit. The specific cutting bit utilized in the hammer is determined by the configuration of the electrolysis cell to be cleaned and the analysis of the crust which is to be broken.

A motor 15 is provided on hammer assembly 2 to rotate hammer 10 and the cutting bit about its longitudinal axis. This rotation of the hammer permits the proper orientation of the edge of the cutting bit relative to the cell which is being cleaned. Motor 15 is mounted on a motor adapter 16 by bolts (not shown) and the motor adapter is connected to a rotator assembly 17. The rotator assembly 17 is also connected to the upper end of motor slide 18 by bolts (not shown). Bearings in rotator assembly 17 permit rotation of the shaft extending downwardly from motor 15 to the connector 12 on hammer 10.

Figure 5:
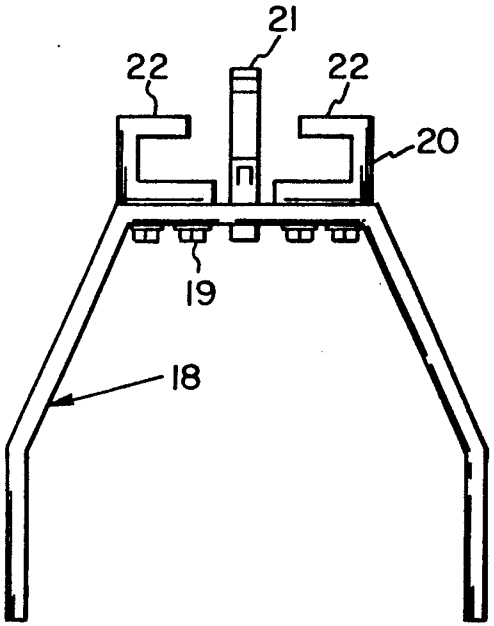
FIG. 5 is a top view of the motor slide shown in FIG. 4.
Figure 4:
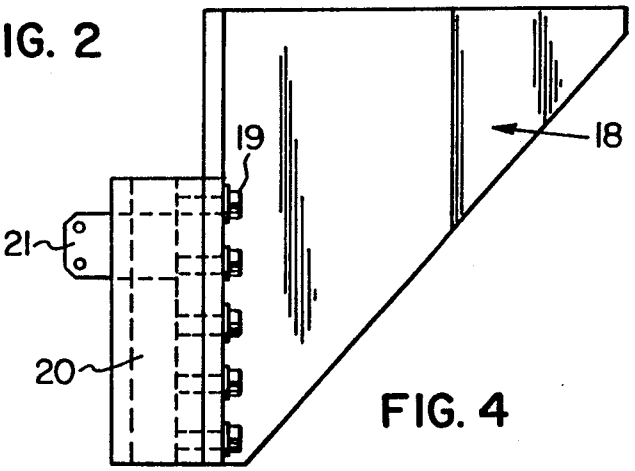
FIG. 4 is a side view of the motor slide shown in FIG. 1.

As clearly illustrated in FIGS. 4 and 5 of the drawings, motor slide 18 is connected by bolts 19 to a hammer assembly slide member 20. Hammer assembly slide member 20 has a plate-like extension 21 which is adapted to engage a slot formed in slide assembly 3. Two opposed inwardly extending fingers 22 on slide member 20 engage a pair of outwardly opening guide grooves formed by a front wear plate and a rear wear plate which are part of slide assembly 3. This arrangement attaches hammer assembly slide member 20 to slide assembly 3 so that hammer assembly 2 is slidable along the length of the guide grooves and the slot formed in slide assembly 3. This "slot and matching key arrangement" guides the hammer assembly as it reciprocates along the length of the guide grooves and the slot.

A chain 40 is attached to the plate-like extension 21 of the hammer assembly slide member 20 through conventional attaching means such as bolts or locking pins. The chain 40 rides on sprockets 41, 42, 43 and 44 and is driven by a conventional air hoist drive 45 which is attached to a mounting member 46 by conventional attaching means. Mounting member 46 is bolted to a side plate 47.

Movement of chain 40 by drive 45 causes plate-like extension 21 of the hammer assembly to travel along the slot in slide assembly 3 to move hammer assembly 2. At the end of a predetermined stroke of the hammer assembly, the drive 45 reverses the direction of travel of chain 40 to return hammer assembly 2 to the initial position. In this manner, cutting bit 11 is reciprocated to breakup the crust formed in a cell. The tension of chain 40 is adjusted by a sprocket adjusting means 49 which adjusts the position of sprocket 41 on side plate 47.

Side plate 47 is mounted for rotation about the axis of rotation 50 of a sprocket 51. The hub 52 of sprocket 51 is attached to side plate 47. A shaft 53 attaches slide assembly 3 to a carriage 54 having front and back plates 55 while bushings permit relative rotation between shaft 53 and slide assembly 3. Sprocket 51 is driven by chain 60 which also engages a drive gear 61 which is concentrically mounted on a sprocket 62. Gear 61 and sprocket 62 are mounted on a shaft which is rotatably mounted on a carriage plate 70. Chain 71 engages sprocket 62 and is driven by a second air hoist drive 63 so that movement of chain 71 causes rotation of sprocket 62 and of gear 61 which, through chain 60, causes the rotation of sprocket 51 and results in a corresponding rotation of side plate 47 and slide assembly 3 about the axis of rotation 50. This tilting of the slide assembly 3, and of associated hammer assembly 1 about axis 50, provides for the desired position of hammer assembly 1 relative to the cell being cleaned. Chain 71 contains a conventional chain adjuster 72 which consists of adjusting bolts attached to the ends of the chain to decrease or increase the effective length of chain. Both chain tension adjusters 72 and 49 provide for operational adjustment of the length of the chains and permit adjustments for maintenance and replacement of parts.

The air hoist drive 63 is attached to carriage frame 80 by a mounting bracket 81. Carriage plate 70 is attached to front plate 55 by carriage mounting plate 82 which aligns with mounting plate 83 formed on the front plate 55. These two mounting plates 82 and 83 are connected by conventional means such as bolts.

Carriage frame 80 includes a general C-shaped roller mounting assembly 90. Four roller mounts 91 are attached to roller mounting assembly 90. Each roller mount 91 supports a roller 92 in a conventional manner such that each roller 92 is free to rotate about its longitudinal axis. The rollers 92 are adapted to travel along a plurality of rails 94. The roller mounts are electrically insulated at A so that rails 94 and support frame 93 are electrically isolated from hammer assembly 2, slide assembly 3 and carriage 54. This permits the crustbreaker to be attached to the superstructure of a pot cell without the danger of a short circuit between the anode bus and the cathode bus.

A carriage drive unit 95 is attached to roller mounting assembly 90 to move the mounting assembly along rails 94. A drive motor 96 is attached to drive unit 95 through a mounting plate 97. The drive motor 96 is a pneumatic motor. A chain 100 is positioned along rails 94 and engages drive motor 96 and sprockets 98 and 99. A chain guide 101 is positioned between sprockets 98 and 99 to deflect chain 100 as the carriage 80 travels along the rails 94.

Conventional controls 110 are provided on the end of roller mounting assembly 90. The controls permit the operator to control the hammer through the drives 45 and 63. Control of drive 45 and motor 96 permits positioning the hammer assembly and the carriage along the rails 94.

The plurality of rails 94, are generally circular in cross section and extend along an axis which is perpendicular to the longitudinal axis of hammer assembly 1 and generally parallel with the axis of rotation of slide assembly 3. The rails 94 are capped at either end to limit travel therealong. The rails are attached to and supported by a support frame 93.

The arrangement of the rails and the rollers illustrated in FIG. 1 of the drawings includes six rails 94 supporting four rollers. The rails 94 are arranged in two sets of three rails each and each set is arranged in a triangle with the longitudinal axis of each rail forming an apex of the triangle. The four rollers 92 are formed in two pairs, and each pair is associated with one triangular set of three rails. One roller of each pair is spaced from the other roller of that pair by approximately 120° when measured from the center of the set of rails which is engaged by that pair of rollers.

The foregoing describes a preferred embodiment of the invention and is given by way of example only. The invention is not limited to any of the specific features described herein, but includes all such variations thereof within the scope of the appended claims.

We claim:

1. A crustbreaking assembly for use in aluminum fusion electrolysis cells comprising:

a plurality of rails extending along a first axis;

a frame supporting said rails;

a carriage adapted to engage and be moveable along said plurality of rails in a direction substantially parallel to said first axis;

a slide assembly;

rotation means for said slide assembly pivotally mounting said slide assembly to said carriage for pivotally movement of said slide assembly about a second axis which is spaced from and substantially parallel to said first axis;

a hammer assembly having a longitudinal axis which is substantially perpendicular to said first and second axes;

means for mounting said hammer assembly on said slide assembly; and means for reciprocating said hammer assembly in a rectilinear manner along said hammer assembly longitudinal axis.

2. The crustbreaking assembly of claim 1 wherein said hammer assembly includes a hammer and a replaceable cutting bit carried by said hammer.

3. The crustbreaker assembly of claim 1 wherein said hammer assembly includes a hammer, a cutting bit carried by said hammer, and a motor for rotating said hammer and said cutting bit about said hammer assembly longitudinal axis.

4. The crustbreaker assembly of claim 1 wherein said carriage includes roller means for engaging and moving said carriage along said plurality of rails.

5. The crustbreaking assembly of claim 4 wherein said carriage includes drive means for moving said carriage along said plurality of rails.

6. The crustbreaking assembly of claim 5 further comprising control means for operationally controlling said carriage drive means, said means for rotating said hammer assembly, said hammer assembly reciprocating means, and said slide assembly rotation means.

7. The crustbreaking assembly of claim 5 wherein said drive means for moving said carriage includes:

a third chain means located along said rails;

a third sprocket means engaging said third chain means;

a third drive motor engaging said third chain means and adapted to move said carriage along the length of said rails in a direction substantially parallel to said first axis; and a chain guide adapted to engage said third chain means.

8. The crustbreaking assembly of claim 7 wherein said hammer assembly includes a hammer assembly attaching means having a plate-like extension attached to said first chain means and two finger means; and wherein said slide assembly includes a front wear plate and a rear wear plate spaced from said front wear plate, said front wear plate and said rear wear plate forming a pair of guide grooves and having a slot formed through said front face of said front wear plate and said rear wear plate, said slot and said guide grooves extending in a direction generally parallel to said hammer assembly longitudinal axis, and said plate-like extension on said hammer attaching means engages said slot and each of said finger means engages one of said guide grooves;

whereby said hammer assembly attaching means is adapted to be moved along the length of said slot and said guide grooves by said first chain means.

9. The crustbreaker of claim 7 wherein said third drive motor is a pneumatically controlled air hoist motor.

10. The crustbreaker of claim 9 wherein said third sprocket means comprises a pair of said third sprockets which engage said third chain means closely adjacent where said third drive motor engages said third chain means, and wherein said third drive motor and said chain guide are positioned between said pair of said third sprockets.

11. The crustbreaker of claim 10 wherein said rails comprise six rails, which are generally circular in cross section and which are arranged in two sets of three rails each; and wherein said roller means comprises four roller assemblies with two of said roller assemblies forming a first pair and engaging two rails of one of said sets of rails and the remaining two of said four roller assemblies forming a second pair of and engaging two rails of the other said set of rails, whereby each said roller assembly is spaced from the other said roller assembly of its respective pair by at least 120° when measured from the center of the said set of rails which the pair engages.

12. The crustbreaker of claim 11 including end pieces each attached to each end of said plurality of rails.

13. The crustbreaking assembly of claim 1 wherein said hammer assembly reciprocating means comprises a first chain means attached to said hammer assembly, a plurality of first sprockets engaging said first chain means, and a first drive motor for driving said first chain means in a reciprocating manner.

14. The crustbreaker of claim 13 wherein said slide assembly includes a sprocket adjusting means for adjusting the position of one of said first sprocket means to adjust the tension on said first chain means.

15. The crustbreaker of claim 13 wherein said first drive motor is a pneumatically controlled air hoist motor.

16. The crustbreaker of claim 15 wherein first sprocket means comprises four sprocket means, wherein a first pair of first sprocket means engages said first chain means closely adjacent where said first chain means engages said first drive means, wherein said first chain means engages said first drive means at a position between said first pair of said first sprocket means, and wherein a second pair of first sprocket means is formed by said one of said first sprocket means and the remaining sprocket of said first sprocket means, wherein said second pair of first sprocket means are spaced from each other by a distance substantially equivalent to the length of said slot and said grooves.

17. The crustbreaking assembly of claim 1 wherein said rotation means for said slide assembly comprises a second chain means having a plurality of chains, a second drive motor attached to said carriage driving one of said second chain means, and a plurality of second sprockets engaging said second chain means and adapted to rotate with movement of said second chain means by said second drive motor, said plurality of second sprockets including a rotation sprocket having said second axis as its axis of rotation and attached to said slide assembly, whereby rotation of the one said second sprocket means results in a corresponding rotation of said slide assembly about said second axis.

18. The crustbreaker of claim 8 wherein said one of said second chain means includes adjustment means to adjust the length of said one of said second chain means.

19. The crustbreaker of claim 17 wherein said second drive motor is a pneumatically controlled air hoist motor.

20. The crustbreaker of claim 19 wherein said second sprocket comprises:

a concentrically mounted gear and outer sprocket attached to each other, and said rotation sprocket fixed to the slide assembly, wherein said outer sprocket engages said one of said plurality of second chain means, and said gear and said rotation sprocket engage a second of said plurality of second chain means, whereby movement of said one of said plurality of second chain means causes rotation of said outer sprocket and said gear, which thereby causes movement of said second of said plurality of second chain means and results in a related rotation of said rotation sprocket and said slide assembly about said second axis.

* * * * *

UNITED STATES PATENT AND TRADEMARK OFFICE

CERTIFICATE OF CORRECTION

PATENT NO. : 5,294,318

DATED : March 15, 1994

INVENTOR(S) : Louis A. Grant, Jr. and Albert J. Kristoff

It is certified that error appears in the above-indentified patent and that said Letters Patent is hereby corrected as shown below:

Claim 16 Line 12 Column 6 after "wherein" insert --said--.

Claim 18 Line 39 Column 6 "8" should read --17--.

Signed and Sealed this

Nineteenth Day of July, 1994

*Attest:*

Bruce Lehman

BRUCE LEHMAN

*Attesting Officer*

*Commissioner of Patents and Trademarks*